United States Patent [19]

Doriguzzi

[11] 3,948,297

[45] Apr. 6, 1976

[54] DEVICE FOR OPERATING THE WEFT NEEDLES IN SHUTTLE-LESS TEXTILE LOOMS

[75] Inventor: Mario Doriguzzi, Milan, Italy

[73] Assignee: Officine Doriguzzi S.a.s., Italy

[22] Filed: Apr. 29, 1974

[21] Appl. No.: 464,757

[30] Foreign Application Priority Data

May 4, 1973 Italy ..... 85555/73

[52] U.S. Cl. ..... 139/123

[51] Int. Cl.[2] ..... D03D 47/08

[58] Field of Search ..... 139/122–124, 139/127, 128

[56] References Cited

UNITED STATES PATENTS

| | | | |
|---|---|---|---|
| 741,279 | 10/1903 | Ryon | 139/123 |
| 743,107 | 11/1903 | Ryon | 139/123 |
| 3,232,320 | 2/1966 | Eilhauer | 139/122 |

*Primary Examiner*—James Kee Chi

*Attorney, Agent, or Firm*—Bucknam and Archer

[57] ABSTRACT

In shuttless textile looms, the reciprocating motion of the weft needle is obtained directly from the oscillation of the sley, without requiring auxiliary transmission units. The sley is connected to a mobile element at the end of which is disposed the weft needle, by means of an oscillating plate, in which a shaped cam is formed. The cam may have an outer working contour or an internal working contour. The reciprocating movement is of adjustable amplitude.

6 Claims, 12 Drawing Figures

DEVICE FOR OPERATING THE WEFT NEEDLES IN SHUTTLE-LESS TEXTILE LOOMS

The object of this invention is to provide a device for operating the weft needles in shuttle-less textile looms, obtaining its movement from the loom sley.

In shuttle-less looms, the weft needles, of one or two in number, must be notably subjected to a predetermined reciprocating motion synchronised with the sley, and this creates the need to provide devices which are generally very complex, especially for the purpose of obtaining a predetermined law of variation of the speed of the weft needles.

By adopting the present invention however, the movement of the weft needle is directly obtained from the oscillation of the sley by way of a kinematic device of very simple concept and easy construction, which enables the oscillating movement of the sley to be transformed into a reciprocating movement of adjustable amplitude in the weft direction, and which makes it possible to predetermine the law of motion of the weft needle in the most suitable manner.

Some embodiments of the device are illustrated by way of non-limiting example in the accompanying drawings, in which.

Figure 1:
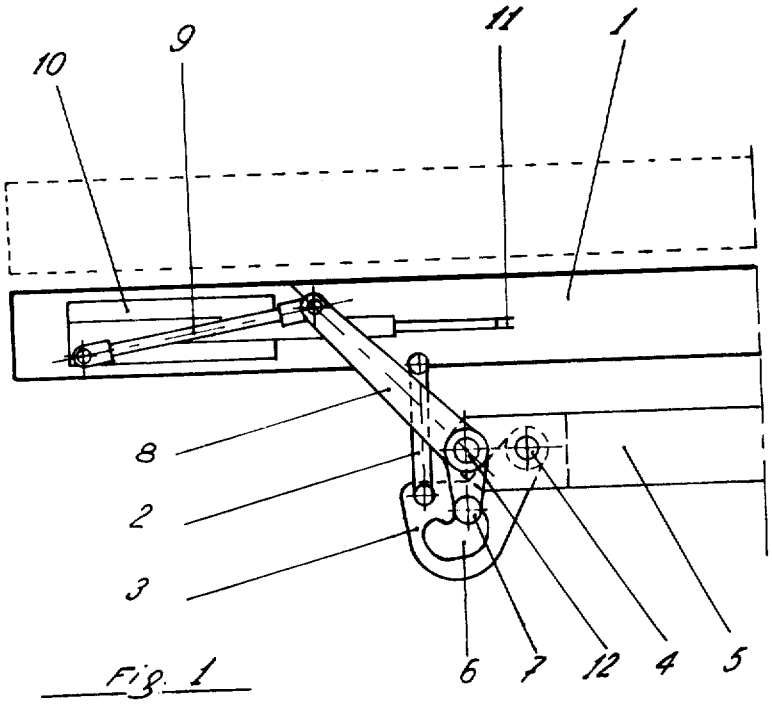
FIGS. 1 and 2 show a first embodiment of the invention, in two different operating positions.
Figure 2:
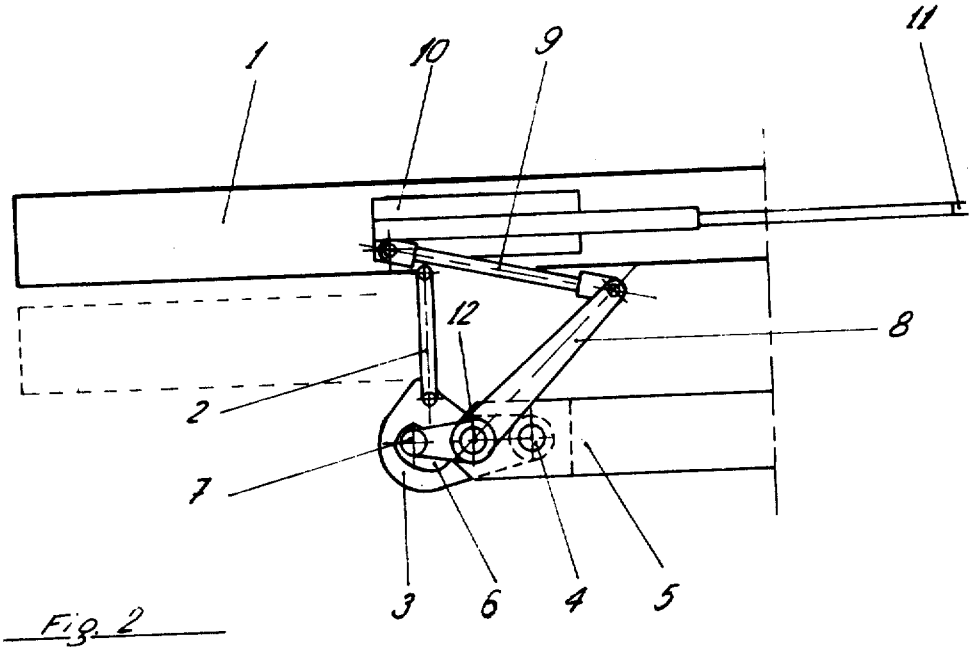

The device for operating the weft needle in a shuttle-less loom according to FIGS. 1 and 2 comprises a stationary frame member 5, a reed for beating weft threads, a movable sley 1 for moving the reed, a weft needle 11 for inserting the weft threads into the shed of the warp, means for transforming the motion of the sley into reciprocating motion of the weft needle, said means being in combination with a motion control device. The combination comprises a rotatable actuating member pivotally mounted on the stationary frame member, a link 2 interconnecting the movable sley with the plate member 3 to produce movement of the plate, the plate member having camming means formed thereon, a reciprocally moving needle actuating member 10 on the sley, a linkage 9 between the needle actuating member and the rotatable actuating member for producing the reciprocal movement of the needle actuating member, with the rotatable actuating member including means acting with the camming means of the plate member for imparting reciprocating motion of controllably variable speed to the weft needle.

The device according to the invention takes its movement from the sley (FIG. 1) connected in an articulated manner by way of the connecting rod 2 to the oscillating plate 3, which is constrained by means of the pivot 4 to a fixed part 5 of the loom.

The oscillating plate 3 is provided with cam means in the form of a suitably shaped cavity 6 in which engages means for acting on the cam means such as a cam follower 7, rigid with the shorter arm of the actuating lever 8, the longer arm of which is connected by way of the articulated connecting rod 9 to the mobile element 10, at the end of which the weft needle 11 is disposed. The actuating lever 8 is pivoted at the fixed point 12.

When the sley 1 moves from the beating position, shown in FIG. 1, to the open position shown in FIG. 2, the plate 3 rotates to cause the angular movement of the actuating lever 8 and consequently the movement towards the loom centre of the element 10, at the end of which the weft needle 11 is disposed.

The return of the sley 1 to the beating position causes the corresponding return of the weft needle 11 to the end of its return stroke.

The cavity 6 is shaped in such a manner that the weft needle is operated in accordance with a required law of motion, for example such as to obtain a delay in the infeed into the warp, smooth and progressive acceleration in the unwinding of the weft, and a regulated exchange at the centre. In this manner, the stroke of the weft needle beyond the reed opening is limited to the distance strictly necessary.

Figure 3:
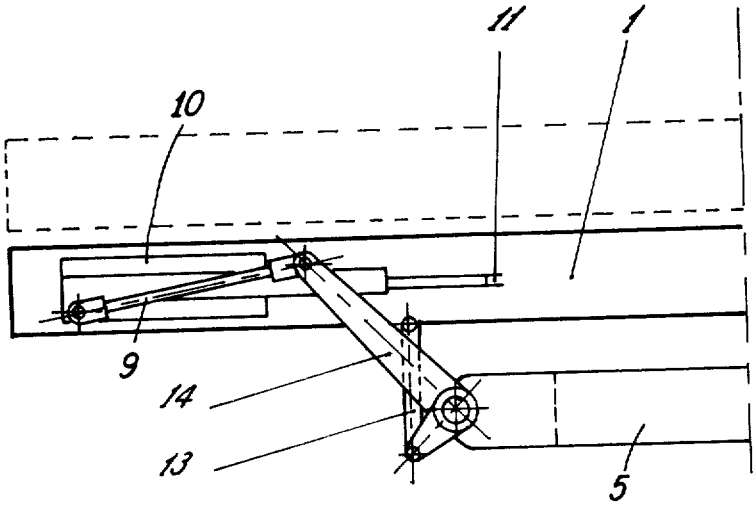
FIGS. 3 and 4 show a second embodiment of the invention, in two different operating positions.
Figure 4:
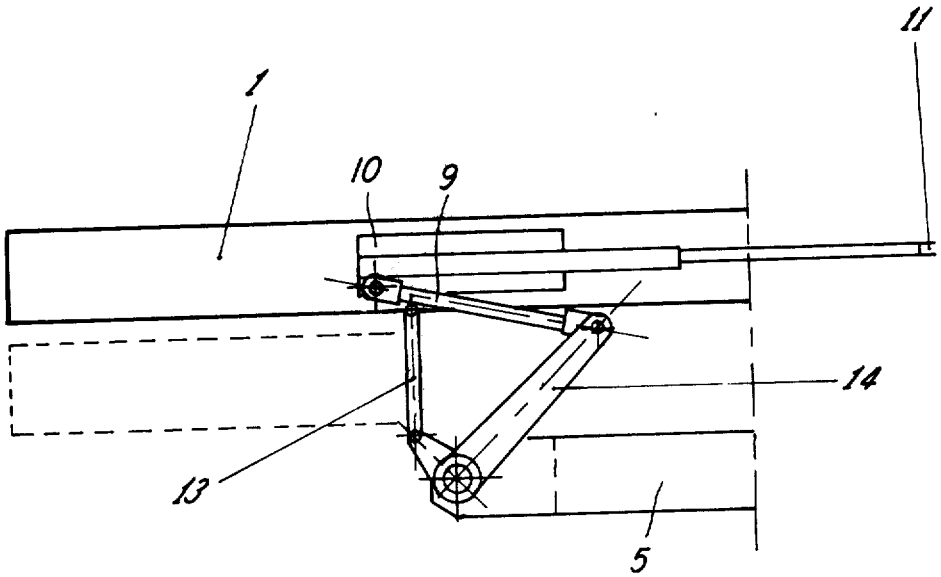

The device heretofore described can be simplified as illustrated in FIGS. 3 and 4, in which the connecting rod 13 directly drives the actuating lever 14 without operating by way of the plate 3 (FIG. 1). The device for operating the the weft needle in a shuttleless loom according to FIGS. 3 and 4 comprises a stationary frame member 5, a reed for beating the weft threads, a movable sley 1 for moving the reed, a weft needle 11 carried by a needle actuating member 10 for inserting the weft threads into the shed of the warp, and means for transforming the motion of the sley into reciprocating motion of the weft needle. These means comprise a rotatable actuating member 14 pivotally mounted on the stationary frame member, a link 13 interconnecting the movable sley with a lever arm on the rotatable actuating member to produce rotation thereof, with the needle actuating member 10 being reciprocally mounted on the sley, and a linkage 9 between the needle actuating member and the rotatable actuating member for producing reciprocal movement of the needle actuating member.

In this manner the law of motion of the weft needle 11 cannot be regulated at will, but this solution may be sufficient for looms having a small reed opening, on the condition that a greater overall length of the loom is acceptable.

Figure 5:
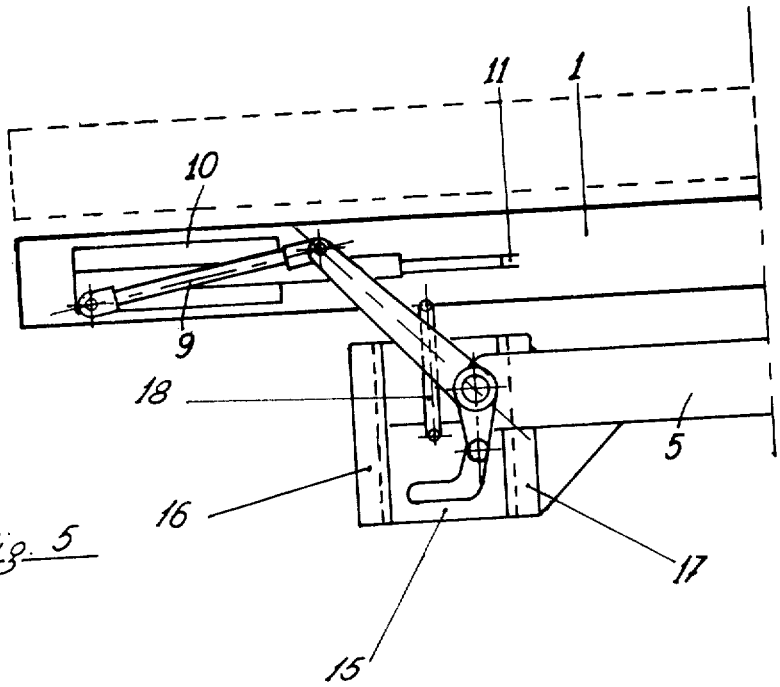
FIGS. 5 and 6 show a third embodiment of the invention, in two different operating positions.
Figure 6:
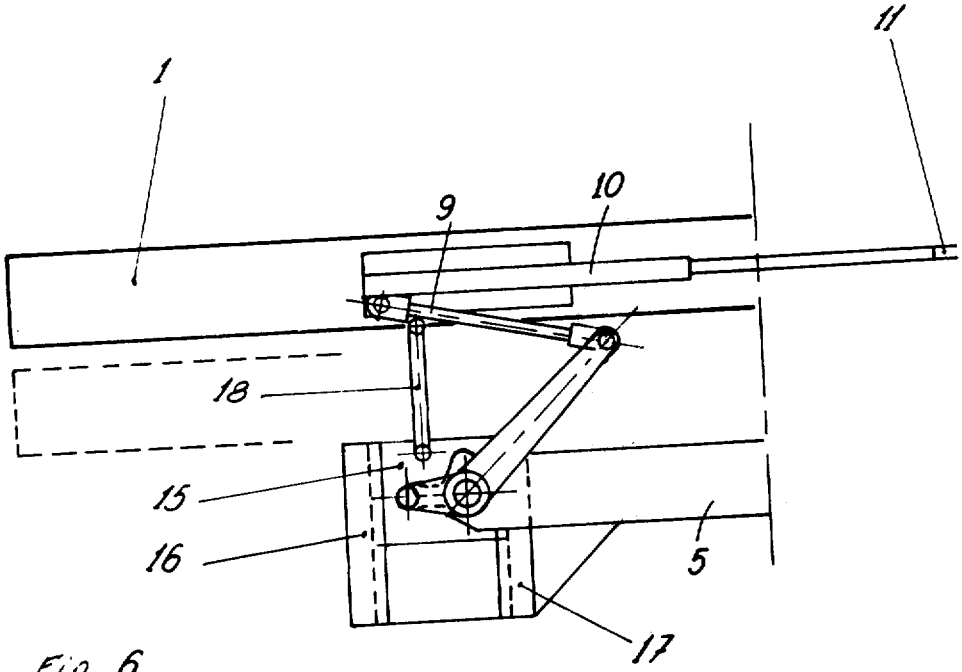

A further modification to the device illustrated is shown diagrammatically in FIGS. 5 and 6, where in place of the oscillating plate 3 (FIG. 1) there is a plate 15 slideable on two guides 16 and 17 fixed on the frame, this latter plate being operated by the connecting rod 18. In the device of FIGS. 5 and 6 the plate member 15 is reciprocally mounted onto the stationary frame member 5 and the plate member reciprocates between two guides 16 and 17 so as to impart reciprocating motion of controllably variable speed to the weft needle in response to the motion of the sley.

Figure 7:
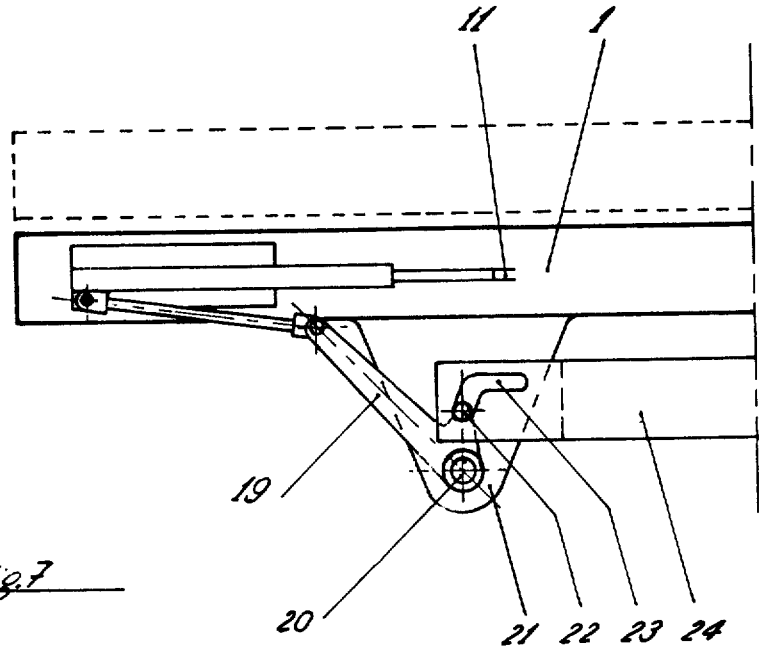
FIGS. 7 and 8 show a fourth embodiment of the invention, in two different operating positions.
Figure 8:
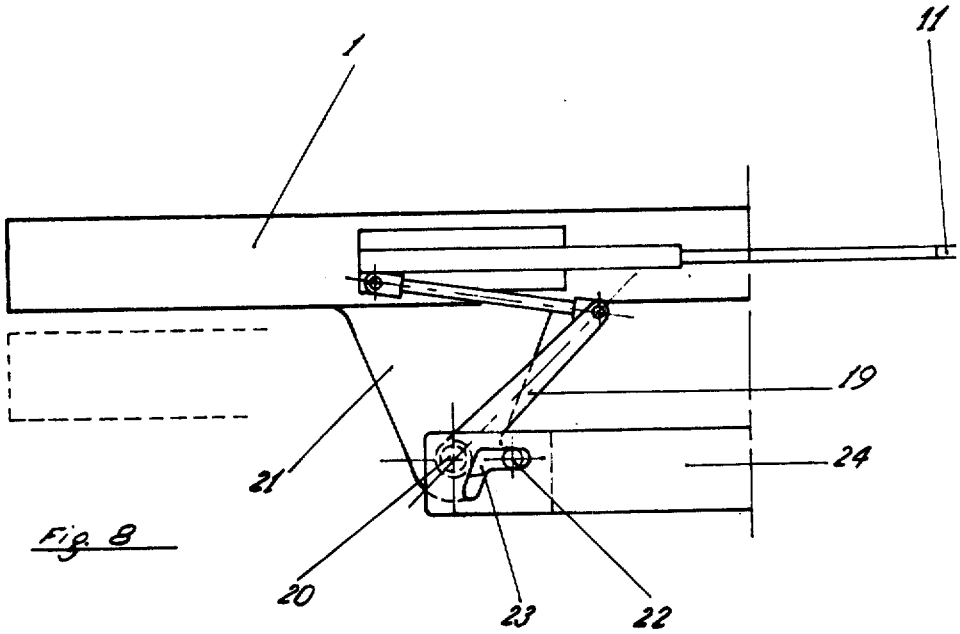

A further modification is shown diagrammatically in FIGS. 7 and 8, in which the actuating lever 19 is pivoted at the point 20 to a bracket 21 rigid with the sley 1, and is engaged by way of the pivot 22 with a shaped cavity 23 formed in a plate 24 disposed in a fixed position with respect to the loom.

In this manner an analogous result is obtained with respect to the embodiment shown in FIGS. 1 and 2, but in a reversed arrangement in that the shaped cavity 23 is disposed in a plate fixed to the loom, whereas in the embodiment shown in FIGS. 1 and 2, the shaped cavity 6 was formed in a plate 3 rotatable on the point 4 fixed to the loom, the plate being driven by the sley 1.

Figure 9:
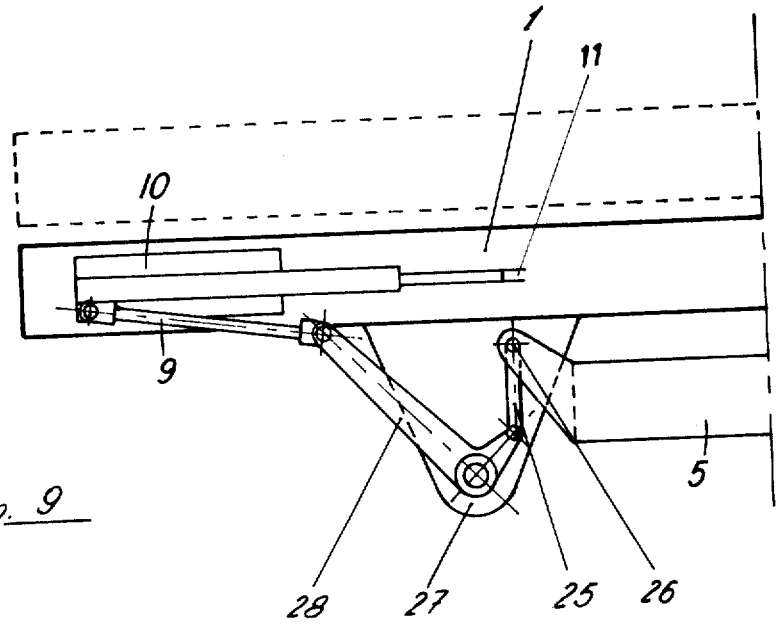
FIGS. 9 and 10 show a fifth embodiment of the invention, in two different operating positions.
Figure 10:
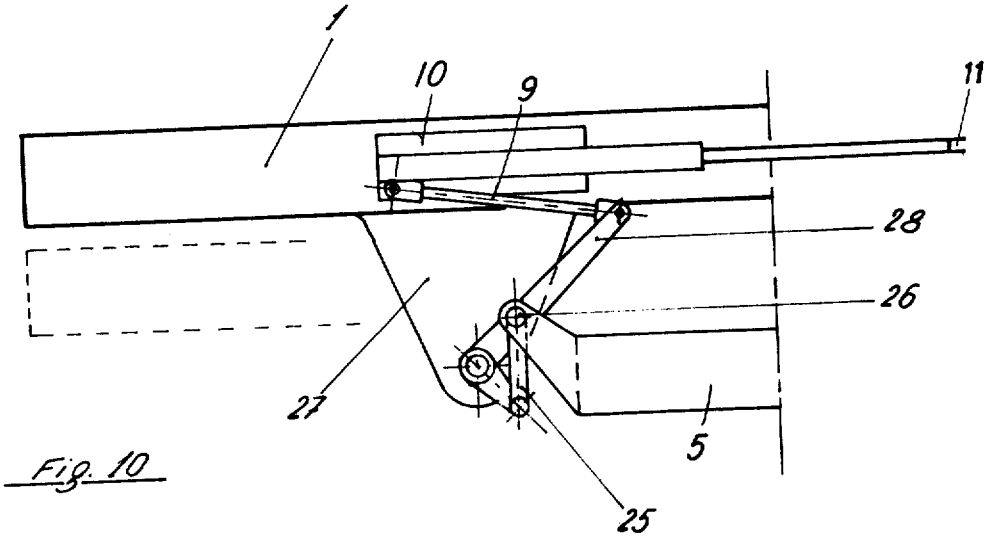

In a further embodiment of the invention, illustrated in FIGS. 9 and 10, the connecting rod 25 is constrained to a fixed point 26 of the loom, and the assembly consisting of the bracket 27 and actuating lever 28 is fixed to the sley. The device for operating the weft needle according to FIGS. 9 and 10 comprises a stationary frame member 5, a reed for beating the weft threads, a movable sley for moving the reed, a weft needle 11 carried by a needle actuating member 10 for inserting the weft threads into the shed of the warp, and means for transforming the motion of the sley into reciprocating motion of the weft needle. These means comprise a lever 28 mounted on bracket 27 which is fixed to the sley, link 25 pivotally mounted on the stationary frame member 5 and connected with one end of lever 28 to produce rotation of the lever from the movement of the sley, with the needle actuating member 11 being reciprocally mounted on the sley, and linkage 9 between the needle actuating member and lever 28.

This embodiment is a simplification of that shown in FIGs. 7 and 8, but does not enable the law of speed variation to be prearranged.

The two embodiments of the invention illustrated in FIGS. 7 and 8 and in FIGS. 9 and 10 respectively can consequently be considered equivalent to those illustrated in FIGS. 1 and 2 and in FIGS. 3 and 4 respectively, in that they produce analogous results while allowing the corresponding simplifications.

Figure 11:
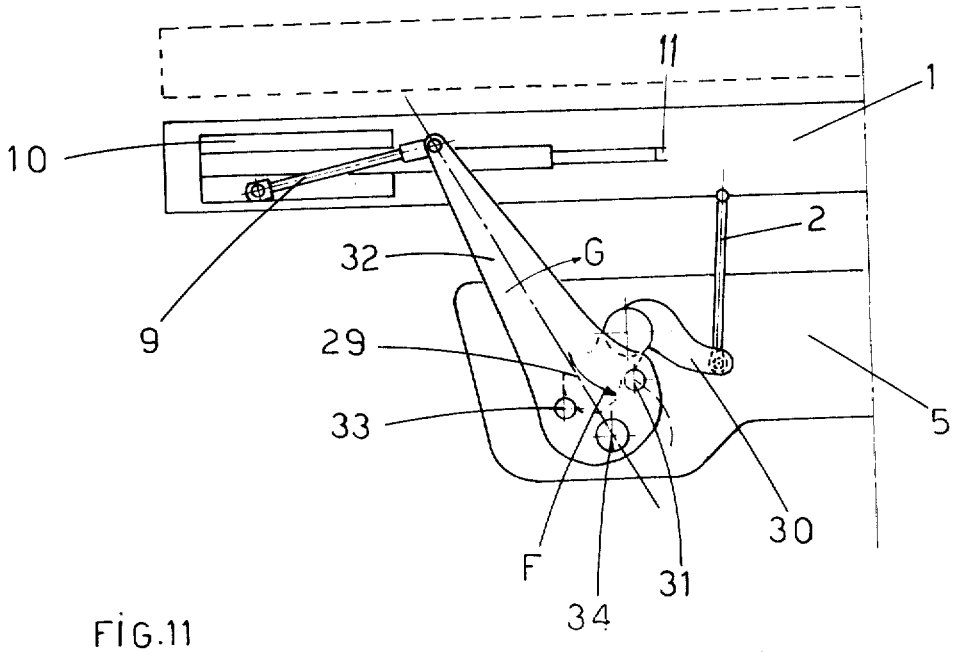
FIGS. 11 and 12 show a sixth embodiment of the invention, in two different operating positions.
Figure 12:
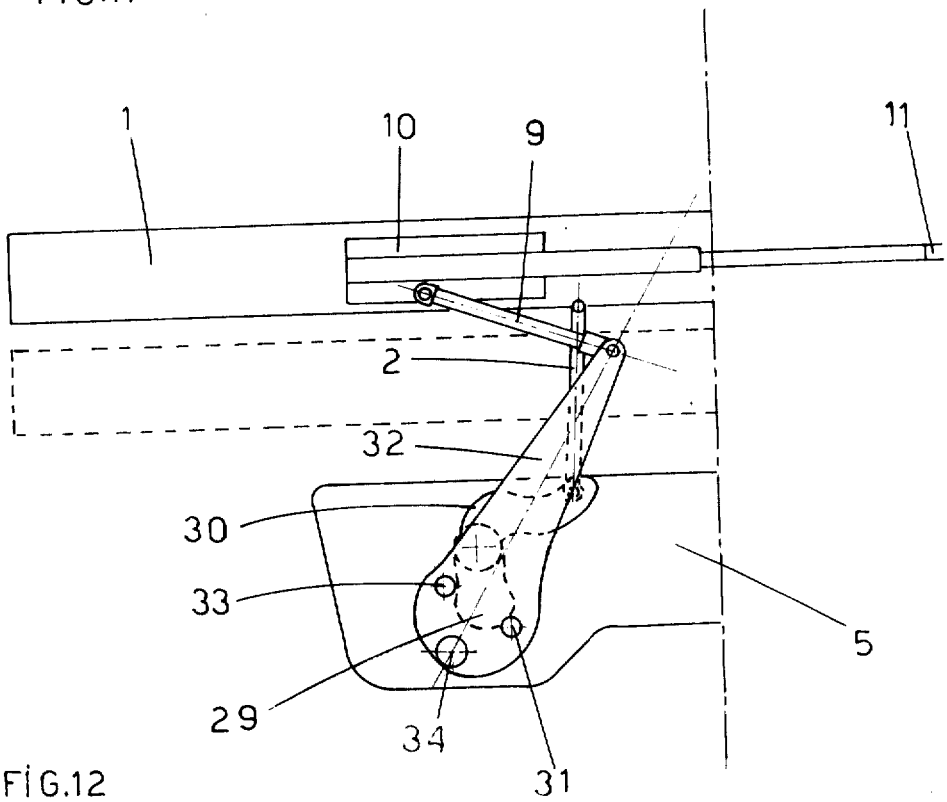

In the embodiment of the invention illustrated in FIGS. 11 and 12, the cam 29 is rigid with a lever 30 rotatable on actuating fixed point of the loom, and driven by the tie rod 2 connected to the sley 1, which when it moves, i.e. passes from the position drawn with a full line in FIG. 11 to the position drawn with a full line in FIG. 12, rotates the cam 29 in the direction indicated by the arrow F, so that it thrusts the roller 31. This latter is rigid with the arm 32 which rotates about the pivot 34 and consequently makes an angular displacement in the direction of the arrow G, dragging the tie rod 9 which moves the mobile element 10, at the end of which the weft needle 11 is disposed.

In its contrary return movement, the sley 1 thrusts the tie rod 2 in such a manner as to rotate the cam 29 in the direction opposite that of the arrow F, the cam 29 colliding against the roller 33, also rigid with the lever 32, and giving rise to the contrary return movement of the mobile element 10 and with it the weft needle 11. The device according to FIGS. 11 and 12 comprises a plate member which is a rigid lever having cam means formed at one end, the lever being pivoted on a fixed point of the stationary frame member, the first rod 2 being connected to the sley and driving the lever. The cam means acts on the two rollers 31 and 33 rigid with the second lever 32, the second lever being pivoted to a fixed point of the stationary frame member, the second lever being connected at its free end to the needle actuating member througn the second connection rod 9.

This embodiment of the invention is very similar to that illustrated in FIGS. 1 and 2, from which it differs only by the fact that the cam 29 is positive, i.e. it has an outer contour, while the cam 3 is negative, i.e. its working contour is internal.

In all the cases heretofore described, the drive for the weft needles, obtained directly from the sley, avoids the need for auxiliary transmission units.

The device can be constructed extremely and economically, and can be applied both in the manufacture of new looms and in the transformation of traditional looms with or without shuttles, the device heretofore described being able to be applied to any type of existing loom.

The constructional details of the device can evidently assume different forms to those described and illustrated in the accompanying drawings, without leaving the scope of the invention.

What we claim is:

1. A device for operating the weft needle in a shuttleless loom which comprises a stationary frame member, a reed for beating the weft threads, a movable sley for moving the reed, a weft needle carried by a needle actuating member for inserting the weft threads into the shed of the warp, means for transforming the motion of the sley into reciprocating motion of said weft needle, said means comprising a rotatable actuating member pivotally mounted on said stationary frame member, a link interconnecting the movable sley with a lever arm on said rotatable actuating member to produce rotation thereof, said needle actuating member being reciprocally mounted on said sley, and a linkage between said needle actuating member and said rotatable actuating member for producing reciprocal movement of the needle actuating member.

2. The device according to claim 1 wherein the link interconnecting the sley with said lever arm is a first rod and said linkage between said needle actuating member and said rotatable member is a second rod, connected to another lever arm.

3. A device for operating the weft needle in a shuttleless loom which comprises a stationary frame member, a reed for beating the weft threads, a movable sley for moving the reed, a weft needle carried by a needle actuating member for inserting the weft threads into the shed of the warp, means for transforming the motion of the sley into reciprocating motion of said weft needle, said means comprising a lever arm pivotally mounted on a bracket which is fixed onto the sley and a link pivotally mounted on said stationary frame member and connected with one end of said actuating member to produce rotation thereof from the movement of the sley, said needle actuating member being reciprocally mounted on said sley and a linkage between said needle actuating member and said lever arm for producing reciprocal movement of the needle actuating member.

4. A device for operating the weft needle in a shuttleless loom which comprises a stationary frame member, a reed for beating the weft threads, a movable sley for moving the reed, a weft needle for inserting the weft threads into the shed of the warp, means for transforming the motion of the sley into reciprocating motion of said weft needle, said means being in combination with a motion control device, said combination comprising a rotatable actuating member pivotally mounted on said stationary frame member, a link interconnecting the movable sley with a plate member to produce movement thereof, said plate member having camming means formed thereon, a reciprocally moving needle actuating member on said sley, a linkage between said needle actuating member and said rotatable actuating member for producing said reciprocal movement of the needle actuating member, said rotatable actuating member including means acting with the camming means of said plate member for imparting reciprocating motion of controllably variable speed to said weft needle.

5. The device according to claim 4 wherein said plate member is reciprocally mounted onto said stationary frame member, said plate member reciprocating between two guides so as to impart reciprocating motion of controllably variable speed to said weft needles in response to the motion of the sley.

6. The device according to claim 4, wherein said plate member is a rigid lever having cam means formed at one end thereof, said lever being pivoted on a fixed point of the stationary frame member, a first rod connected to said sley drives said lever, said cam means acts on two rollers rigid with a second lever, said second lever being pivoted to a fixed point of the stationary frame member, said second lever being connected at its free end to said needle actuating member through a second connecting rod.

* * * * *